US005235563A

United States Patent [19]

Ganter et al.

[11] Patent Number: 5,235,563

[45] Date of Patent: Aug. 10, 1993

[54] AUTONOMOUS RADIO TIMEPIECE

[75] Inventors: Wolfgang Ganter, Schramberg; Oskar Flaig, Eschbronn/Locherhof; Roland Maurer, Lauterbach, all of Fed. Rep. of Germany

[73] Assignee: Junghans Uhren GmbH, Schramberg, Fed. Rep. of Germany

[21] Appl. No.: 732,127

[22] Filed: Jul. 18, 1991

[30] Foreign Application Priority Data

Jul. 20, 1990 [DE] Fed. Rep. of Germany ..... 9010813

[51] Int. Cl.[5] ..... G04C 11/02

[52] U.S. Cl. ..... 368/47; 368/10; 368/55

[58] Field of Search ..... 368/47, 46, 48–59, 368/10

[56] References Cited

U.S. PATENT DOCUMENTS 4,645,357 2/1987 Allgaier et al. ..... 368/187
4,650,344 3/1987 Allgaier et al. .
5,083,123 1/1992 Ganter et al. .
5,105,396 4/1992 Ganter et al. .

FOREIGN PATENT DOCUMENTS 0242717 10/1987 European Pat. Off. .
3510637 5/1986 Fed. Rep. of Germany .

*Primary Examiner*—Bernard Roskoski

*Attorney, Agent, or Firm*—Burns, Doane, Swecker & Mathis

[57] ABSTRACT

An autonomous radio timepiece (11) with a magnetic antenna (14) located in the vicinity of a electromechanical transducer (25) for driving a time display (19), in order to obtain a radio timepiece with a small volume and operable in a compact manner. To avoid electromagnetic interference with the antenna inlet of a tuned radio-frequency receiver (12), the transducer (25) is deactivated while the receiver (12) is actuated for the reception and coding of an absolute time information (15) transmitted by radio. A subsequent recovery of the transducer drive pulses (42) for autonomous time keeping corrects the display (19). However, a transducer (25.1) may remain in uninterrupted operation if it is located relative to the antenna coil (33) with the relative position of its core (34) in a manner such that components of the stray current or electro magnetic field (39) exiting from the frontal side of the transducer field coil (39) in a fan-like manner passes through the antenna coil (33) in opposite directions, so that the two components (*39a*, *39b*) of the stray current offset or cancel each other out. In a two-motor radio timepiece mechanism, the second transducer (25.2), the stator stray current (39.2) thereof cannot be compensated in the antenna coil (33), remains deactivated during the operation of the receiver and is assigned to the display means (19) with the slowest advancing action, for example, the hour hand in case of a separate drive of the minute and possibly the seconds hand.

12 Claims, 2 Drawing Sheets

AUTONOMOUS RADIO TIMEPIECE

BACKGROUND OF THE INVENTION

1) Field of the Invention

The invention concerns an autonomous timepiece with an electromagnetic transducer built into a case for an electromechanical display, the transducer being magnetically decoupled from an antenna connected to a receiver.

2) Description of Related Art

A timepiece of this type is described for example in DE-OS 35 10 637 which introduced to the market the JUNGHANS radio timepiece technology. It is not necessary to locate a magnetic long-wave antenna outside the timepiece (for example, in an inhabited room) and it may be installed in the casing of the timepiece. However, the antenna must be placed as far as possible from the case. If, for reasons of the circuitry required the radio timepiece mechanism, the timepiece is equipped a tuned radio-frequency receiver, rather than a superheterodyne receiver, there might be interfering reactions, particularly from the electromagnetic transducer. While with a superheterodyne receiver, the intermediate frequency conversion may result in decoupling.

When equipping a radio timepiece with a tuned radio-frequency receiver, the relatively large mass of the antenna coil, together with the ferrite core extending through it, must be connected externally with the receiver circuit by means of a long flexible cable. The long flexible cable is cumbersome and prone to failure, for example, in shipping or in the installation of such a radio timepiece mechanism in the mountings of a saleable consumer timepiece.

SUMMARY AND OBJECTS OF THE INVENTION

In view of the above conditions, it is an object of the present invention to equip a timepiece of the above-mentioned type with a mechanism, which in spite of the small volume of its case and of the use of a tuned radio-frequency receiver, makes possible the installation of the magnetic antenna in the case itself and thus in relatively close vicinity with the electromagnetic transducers moving the time display means, without the actuation of the transducers leading to interference with the reception by the adjacent magnetic antenna.

This is attained according to the invention essentially by a radio timepiece of the aforementioned generic type equipped with a mechanism in which an antenna is also built into the case. The antenna is positioned in the case in a manner such that the magnetic stray current or field exiting from the transducer field coils on the frontal side pass through the antenna coil in opposing directions, thereby compensating for itself by creating an equal and opposite reaction in the antenna coil.

According to this solution, an electromechanical transducer, for example a step motor for the quasicontinuous drive of a hands mechanism, is installed relatively adjacent to the antenna coil in the case in a manner such that the stator coil of the transducer is oriented with one frontal end of the antenna coil, which in turn is to be oriented transversely to the stator coil, so that the two branches or components of the dipole like stator stray electro magnetic field pass through the antenna coil in opposite directions. By displacing the coil core and/or pivoting the transducer stator, it is possible to adjust the components of the stray current (electromagnetic field) in the coil so that they just compensate each other. The result is that the operation of the transducer generates no electromagnetic interference on the antenna coil with respect to the receiver inlet.

If, on the other hand, for reasons of space this compensation of the stator stray current in the antenna coil cannot be realized accurately enough (for example, because a second transducer is to be installed in the case), the transducer, the stray current of which is not compensated adequately, is deactivated while the receiver is in operation. In this embodiment, the display movement lost due to this temporary deactivation is restored after the receiver has been reactivated.

In a mechanism with two motors, advantageously the transducer driving the most rapidly moving display means (i.e., for example the minute or possibly the second hand) is positioned so that the transducer stray current is canceled out in the antenna coil. This allows this particular transducer to be maintained in operation as continuously as possible. In contrast, a slow display means (for example, an hour hand) can be associated with the second transducer which is not positioned optimally relatively to the antenna core. This transducer may be readily deactivated during the temporary operation of the receiver since the deactivation is hardly noticeable in view of the slow movement of the display and requires few subsequent advancing steps to recover. This further development of the solution according to the invention therefore makes possible in particular a highly compact configuration of a two-motor radio timepiece mechanism without the need for external antenna connections such as described in more detail for example in U.S. Pat. No. 4,645,357.

BRIEF DESCRIPTION OF THE DRAWINGS

Further alternatives and developments of the invention will become apparent from the attached claims, abstract of the disclosure and from the following detailed description of the preferred embodiment of the solution according to the invention, shown in the drawings. In the drawings:

DESCRIPTION OF THE PREFERRED EMBODIMENTS

Figure 1:
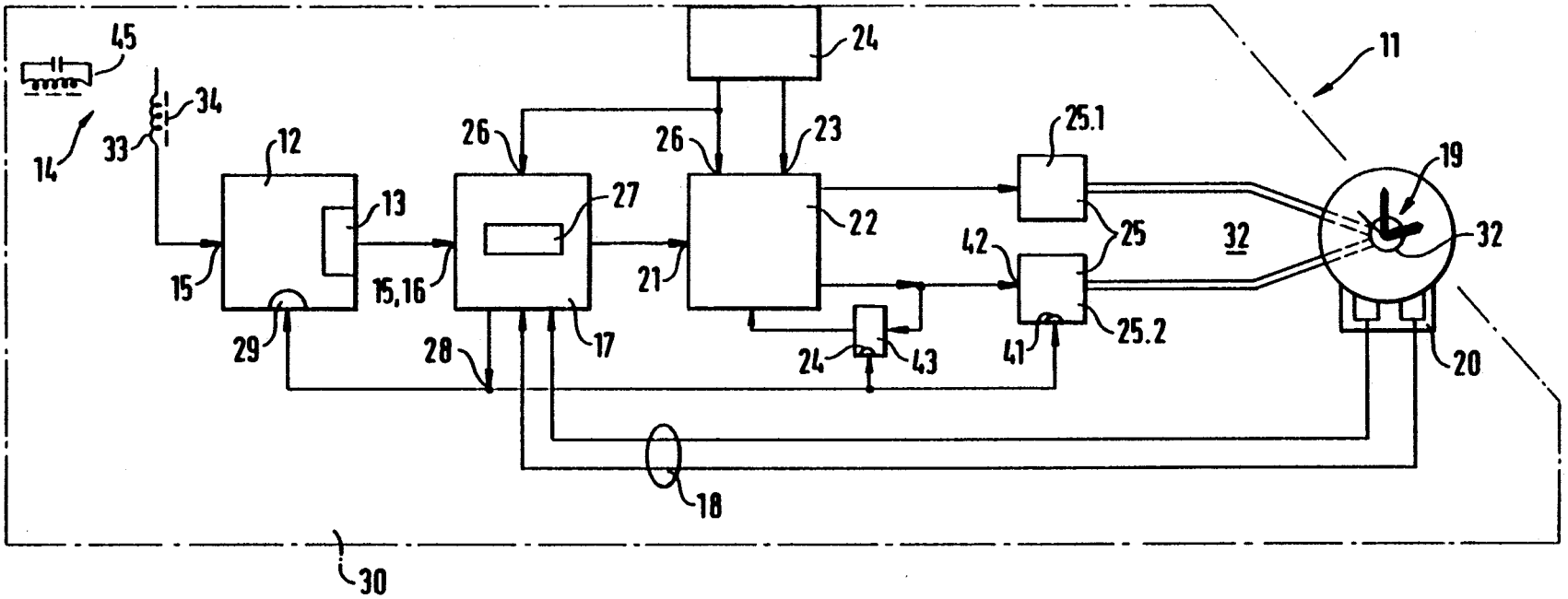
FIG. 1 shows a single-pole block circuit diagram a timepiece an antenna built into its case which permits an interruption of the operation of a slow display transducer during the operation of a receiver.

The radio timepiece 11 includes, as described in more detail in the aforecited patent literature of Applicant, a radio receiver 12 tuned to a transmitter of coded absolute time information, together with a demodulator 13. An antenna 14 supplies, provided that adequate radio receiving conditions exist, a high frequency signal modulated, for example, in the minute sequence, with binary coded instantaneous time information 15. The latter appears behind the demodulator 13 as a signal sequence pulse modulated in the seconds grid 16 at the inlet of a comparator circuit 17. In this embodiment, the instantaneous time information 15 received by radio is compared with a display information 18 representing the instantaneous setting of electromechanical display 19 (shown in the drawing as hands in front of a dial) and supplied by a display detector 20. The display detector 20 may be, for example, a light barrier and counting device to detect the instantaneous position of the electromechanical display means 19.

If the prevailing setting of the electromechanical display means 19 does not correspond to the instantaneous time information 15, a control signal 21 emitted by the comparator circuit 17 causes an oscillator circuit 24 in a control circuit layout 22 to emit a higher frequency advancing signal 23 to the electromechanical transducers 25.1 and 25.2, until the time indication on the display means 19 coincides with the instantaneous absolute time information 15. Subsequently, the control signal 21 switches, by means of the control circuit 22, to a time keeping stepping signal 26 which is fed to the transducer or transducers 25.1 and 25.2, and the timepiece 11 is then operated by the time keeping oscillator circuit 24, with the receiver 12 deactivated in order to save energy. This feature of the timepiece 11 is why it is designated an "autonomous timepiece".

A time register 27 in the comparator 17 is set by the decoded instantaneous time information 15 and advanced in a time keeping manner by the oscillator circuit 24. The time register 27 interrupts a stop signal 28 at the deactivating inlet 29 of the receiver 12 prior to certain predetermined points in time (for example, hourly) in order to repeat the above-described comparison of the actual time display with the absolute time information 15 received by radio and possibly to correct the instantaneous setting of the display means 19.

Figure 2:
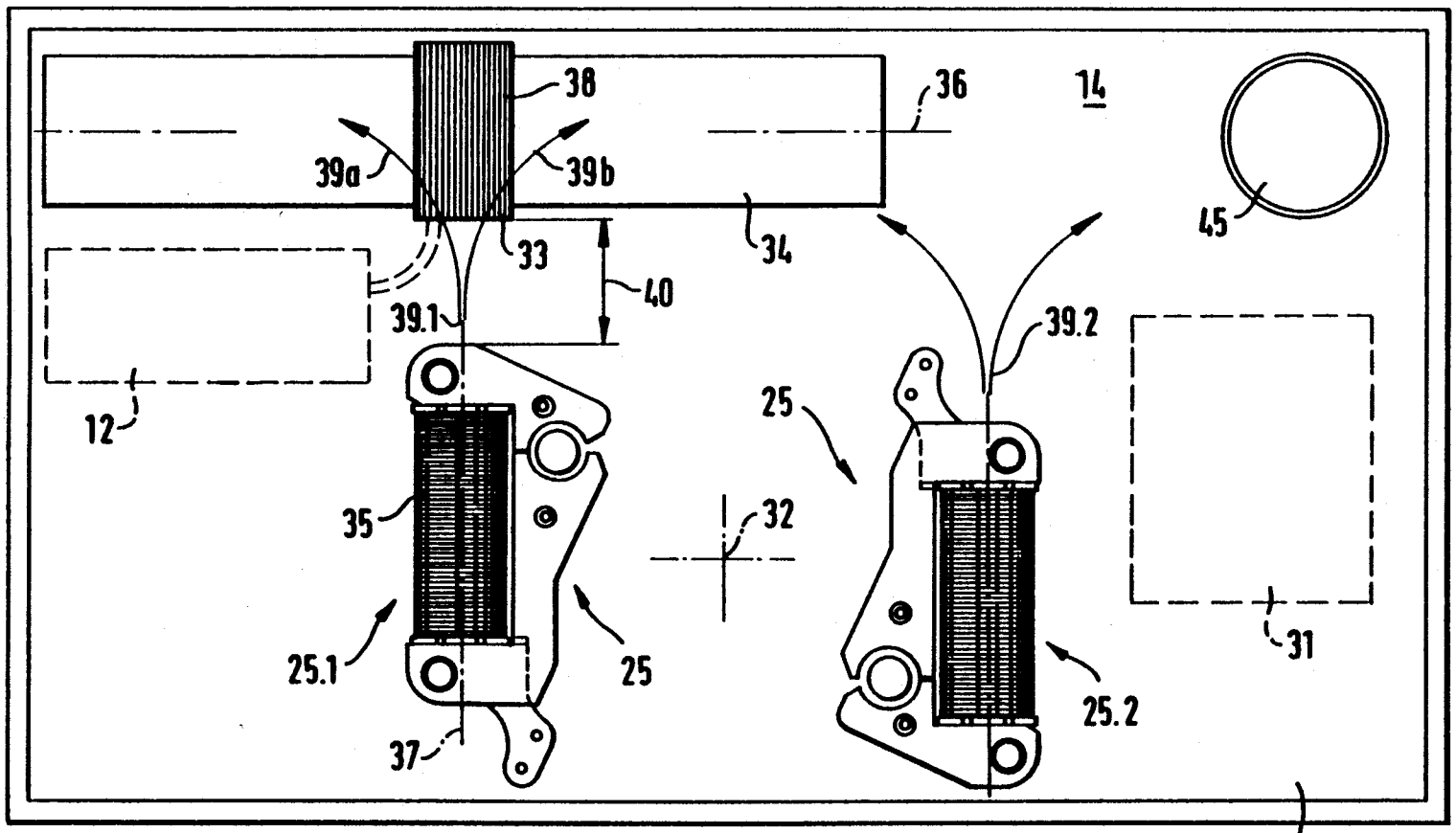
FIG. 2 shows approximately true to scale an embodiment of the layout of two transducers in a timepiece case with a built-in antenna comprising orthogonally oriented coils with rod cores.

As shown in FIG. 2, in a case 30 the switching circuits of a receiver 12 and the switching circuits of the comparator circuit 17 are arranged in a compact manner. The case further houses the control circuit 22 and the oscillator circuit 24 (which may be advantageously in the form of an integrated processor circuit 31), and also the electromechanical transducers 25 for the display means 19. The transduces 25 may be in the form of miniaturized electric motors for the continuous or stepped drive of a hands mechanism 32. Additionally, an antenna 14 is arranged within the case 30 and thus in the immediate vicinity of the electromechanical transducers 25. The antenna 14 may be in the form of a magnetic or frame antenna with at least one coil 33 connected with the receiver 12 and with a core (e.g., a ferrite core) 34 axially extending through it.

The field coil 35 of the transducer 25 (or one of the transducers 25.1 in a two coil embodiment) is aligned transversely to the axis 36 of the antenna coil 33 and fixed at a certain distance from it in a manner such that the field coil axis 37 extends in a direction through the symmetrical center 38 so that the two branches or components of the stray current 39*a*, 39*b* act with the same intensity but in opposing directions on the antenna coil 33 with consideration of its position on the core 34. In case of field asymmetries it is possible to insure that the effects of the opposing directions of the transducer stray current exactly compensate each other in the antenna coil 33. This is done by means of a slight pivoting of the field coil axis 37 during the mounting of the transducer 25.1 and/or the position of the core 34 in the antenna coil 33 or their positioning relative to the transducer 25.1, so that there is no net magnetic interference by the transducer 25.1 on the antenna 14 and therefore the reception and the decoding of the high frequency modulated time information 15 in the receiver 12 is not disturbed by the simultaneous operation of the transducer 25.1 adjacent to the antenna 14 and the radio receiver 12.

The large stray current distance 40 between the antenna 14 and the adjacent frontal end of the transducer 25.1 to be obtained in spite of the small internal dimensions of the case 30, may be further enlarged for a given cross section area of the antenna core 34 by using a rectangular core wound with the antenna coil 33 in place of a conventional round core 34.

If the case 30 of the radio timepiece 11 is equipped with two transducers 25.1 and 25.2 instead of one, it is not practical to locate the second transducer 25.2 symmetrically relative to the antenna 14, so that its magnetic stray field—independently of whether the first transducer 25.1 is operating or not—does not interfere with the antenna coil 33 and thus with the operation of the receiver 12. In order to prevent such an interference, the second transducer 25.2 is deactivated whenever the receiver 12 is actuated for reception.

This is shown in FIG. I by an inhibit inlet 41 at the actuating circuit of the second transducer 25.2. The inlet 41 blocks the operation of the transducer in the absence of the stop signal 28, i.e., during the operation of the receiver 12. While this causes a false indication by the associated display, this may be restored, as described above, for example by means of the comparator circuit 17. To restore the display, it may functionally even more simple to count the drive pulses 42, as shown in FIG. 1, which do not act on the step advance of the associated display due to the instantaneous actuation of the receiver 12, in a register 43. From register 43, they are rapidly emitted (by means of the control circuit 22 or directly to the transducer 25.2) as soon as the stop signal 28 reappears and indicates that the receiver 12 is now deactivated. At this time the operation of the transducers 25.2 (positioned in a non-compensating location) may be resumed without interference with the receiving operation.

The transducer 25.2, the positioning of which relative to the antenna 14 does not neutralized stray currents, is therefore deactivated whenever the receiver 12 is activated to receive information from the antenna 14, so that the transducer 25.2 does not interfere with the operation of the receiver 12. However, subsequently the missing motion units of the transducer 25.2 are recovered, whereupon the display position of the display means 19 again corresponds to the actual point in time. This temporary erroneous indication due to the interruption of the operation of the transducer 25.2 is hardly noticeable in view of the relatively short actuation periods of the receiver 12. This is particularly so if a relatively slow moving display means is involved, such as for example the hour hand in front of the dial. Such an hour hand is advanced at the most in a minute cycle and in case of an undisturbed reception of the high frequency time information 15 the receiver 12 is deactivated at the latest after one or two minutes. This means that usually only one motor pulse is briefly delayed, which is practically undetectable by a viewer of the time display.

If the above-described antenna 14 is to be supplemented by an auxiliary antenna 45, such as described in detail in EP-OS 0 242 717, in order to improve the all around receiving properties of the antenna 14, the auxiliary antenna 45 (which is oriented transversely relative to the main antenna core 34, separately tuned and not connected with the receiver 12) is preferably built into the case 30 in a manner such that the second transducer 25.2 (which is not positioned optimally relative to the main antenna) is located approximately between these two partial antennas, but offset to their common plane (as shown in FIG. 2).

What is claimed is:

1. An autonomous radio timepiece comprising:

a timepiece case;

an antenna, including an antenna coil housed in the timepiece case, for receiving radio signals and outputting a signal;

a receiver for receiving said signal;

electromechanical display means for displaying time information; and electromagnetic transducer means built into the timepiece case for driving the electromechanical display means, said transducer includes at least one transducer magnetic field coil and said at least one coil being magnetically decoupled from the antenna connected with the receiver, wherein the antenna is positioned in the timepiece case so that components of a magnetic field exiting from said at least one transducer field coil pass through the antenna coil in opposing directions to cancel the effects of each other magnetic field component on the antenna.

2. The autonomous radio timepiece according to claim 1, wherein the antenna coil is located on a core having a rectangular cross section, the longitudinal axis whereof extends approximately transversely to the field coil axis of said at least one transducer.

3. The autonomous radio timepiece according to claim 1, further comprising an auxiliary antenna built into the case, said auxiliary antenna being aligned orthogonally relative to both an axis of the antenna coil and an axis of one transducer field coil and located at a distance from an end surface of the antenna core.

4. The autonomous radio timepiece according to claim 2, further comprising an auxiliary antenna built into the case, said auxiliary antenna being aligned orthogonally relative to both an axis of the antenna coil and an axis of one transducer field coil and located at a distance from an end surface of the antenna core.

5. The autonomous radio timepiece according to claim 1, wherein a transducer with a magnetic field compensated in the antenna coil may be operated independently of the operation of the receiver, while a transducer with a magnetic field poorly compensated or uncompensated in the antenna coil is deactivated during the actuation of the receiver and may be supplied subsequently with a previously suppressed advance stepping information.

6. The autonomous radio timepiece according to claim 2, wherein a transducer with a magnetic field compensated in the antenna coil may be operated independently of the operation of the receiver, while a transducer with a magnetic field poorly compensated or uncompensated in the antenna coil is deactivated during the actuation of the receiver and may be supplied subsequently with a previously suppressed advance stepping information.

7. The autonomous radio timepiece according to claim 3, wherein a transducer with a magnetic field compensated in the antenna coil may be operated independently of the operation of the receiver, while a transducer with a magnetic field poorly compensated or uncompensated in the antenna coil is deactivated during the actuation of the receiver and may be supplied subsequently with a previously suppressed advance stepping information.

8. The autonomous radio timepiece according to claim 4, wherein a transducer with a magnetic field compensated in the antenna coil may be operated independently of the operation of the receiver, while a transducer with a magnetic field poorly compensated or uncompensated in the antenna coil is deactivated during the actuation of the receiver and may be supplied subsequently with a previously suppressed advance stepping information.

9. The autonomous radio timepiece according to claim 1, wherein the case houses two electromagnetic transducers, one of which is a higher frequency transducer for driving a rapidly moving time display means in an uninterrupted operation with compensation of its magnetic field in the antenna coil, while the other of which is a lower frequency transducer for driving a slower moving time display means without substantial compensation of its magnetic field, the lower frequency transducer being deactivated during the operation of the receiver by blocking drive pulses thereto and subsequently adjusted by entry of the temporarily blocked drive pulses.

10. The autonomous radio timepiece according to claim 2, wherein the case houses two electromagnetic transducers, one of which is a higher frequency transducer for driving a rapidly moving time display means in an uninterrupted operation with compensation of its magnetic field in the antenna coil, while the other of which is a lower frequency transducer for driving a slower moving time display means without substantial compensation of its magnetic field, the lower frequency transducer being deactivated during the operation of the receiver by blocking drive pulses thereto and subsequently adjusted by entry of the temporarily blocked drive pulses.

11. The autonomous radio timepiece according to claim 3, wherein the case houses two electromagnetic transducers, one of which is a higher frequency transducer for driving a rapidly moving time display means in an uninterrupted operation with compensation of its magnetic field in the antenna coil, while the other of which is a lower frequency transducer for driving a slower moving time display means without substantial compensation of its magnetic field, the lower frequency transducer being deactivated during the operation of the receiver by blocking drive pulses thereto and subsequently adjusted by entry of the temporarily blocked drive pulses.

12. The autonomous ratio timepiece according to claim 4, wherein the case houses two electromagnetic transducers, one of which is a higher frequency transducer for driving a rapidly moving time display means in an uninterrupted operation with compensation of its magnetic field in the antenna coil, while the other of which is a lower frequency transducer for driving a slower moving time display means without substantial compensation of its magnetic field, the lower frequency transducer being deactivated during the operation of the receiver by blocking drive pulses thereto and subsequently adjusted by entry of the temporarily blocked drive pulses.

* * * * *